US008081131B2

(12) United States Patent
Pidwerbetsky et al.

(10) Patent No.: US 8,081,131 B2
(45) Date of Patent: Dec. 20, 2011

(54) MULTI-POLARIZED ANTENNA ARRAY

(75) Inventors: Alex Pidwerbetsky, Randolph, NJ (US); Howard R. Stuart, Glen Ridge, NJ (US)

(73) Assignee: Alcatel Lucent, Paris (FR)

( * ) Notice: Subject to any disclaimer, the term of this patent is extended or adjusted under 35 U.S.C. 154(b) by 459 days.

(21) Appl. No.: 12/236,598

(22) Filed: Sep. 24, 2008

(65) Prior Publication Data

US 2010/0073237 A1 Mar. 25, 2010

(51) Int. Cl.
*H01Q 9/28* (2006.01)

(52) U.S. Cl. ..... 343/795; 343/814; 343/867; 343/742

(58) Field of Classification Search ..... 343/700 MS, 343/741, 742, 866, 867, 810, 814, 795, 797
See application file for complete search history.

(56) References Cited

U.S. PATENT DOCUMENTS 7,777,685 B2 * 8/2010 Stuart ..... 343/795

OTHER PUBLICATIONS www.nature.com; "Tripling the capacity of wireless communications using electromagnetic polarization;" Michael R. Andrews, et al; Nature/vol. 409; Jan. 18, 2001; pp. 316-318.

U.S. Appl. No. 11/540,442, filed Sep. 2006, Stuart, Howard R.

* cited by examiner

*Primary Examiner* — Dieu H Duong

(74) *Attorney, Agent, or Firm* — Mendelsohn, Drucker & Associates, P.C.

(57) ABSTRACT

In one embodiment, the present invention is a dual-polarized antenna array constructed from first and second instances of a planar antenna that are co-located and orthogonal to one another. The planar antenna comprises three conducting elements and a transmission line. The first conducting element comprises a straight segment and two arms of equal length. The proximal ends of the two arms are attached to opposite ends of the straight segment. The arms extend away from the second and third conducting elements and towards one another. The second and third conducting elements are separated by a gap and together form a mirror image of the first conducting element. The transmission line has first and second conductors that are coupled to the second and third conducting elements, respectively. In another embodiment, the present invention is a tri-polarized antenna array constructed from three orthogonal co-located instances of the planar antenna.

23 Claims, 4 Drawing Sheets

MULTI-POLARIZED ANTENNA ARRAY

CROSS-REFERENCE TO RELATED APPLICATIONS

The subject matter of this application is related to U.S. patent application Ser. No. 11/540,442 filed Sep. 29, 2006, the teachings of which are incorporated herein by reference in its entirety.

BACKGROUND OF THE INVENTION

1. Field of the Invention

The present invention relates to wireless communications systems, and, in particular to antenna arrays used by such systems that employ multiple polarizations.

2. Description of the Related Art

Multiple-input multiple-output (MIMO) technologies are well known in the field of wireless communications. In general, these technologies use multiple antennas at both the transmitter and the receiver of a communications system to perform communications. Communications systems that employ MIMO technologies may achieve certain performance improvements over single-input single-output (SISO) systems that use only one antenna at both the transmitter and the receiver.

For example, in fading environments, MIMO technologies may be used to improve reliability of communications. In such environments, a transmitted signal may travel over multiple different propagation paths to a receiver antenna. Each propagation path carries a version of the transmitted signal that is altered due to factors such as the length of the path, the number of reflections in the path, and the characteristics of any objects in the path. These factors may vary from one path to the next, and, as a result, each version of the transmitted signal may arrive at the receiver antenna with a delay, a signal attenuation, and a phase shift that are different from those of the other versions. As the multiple versions arrive at the receiver antenna, they may constructively or destructively interfere with one another such that the signal received by the receiver is an amplified or attenuated version of the transmitted signal. If attenuation is relatively severe, then errors may result when decoding the received signal, thereby preventing the receiver from recovering the communicated information.

MIMO technologies may be used to prevent these errors from occurring. In particular, MIMO technologies may be used to create multiple "diverse" copies of the information being communicated so that the receiver may have multiple opportunities to decode the information. When one or more copies experience relatively severe attenuation, the communicated information may be recovered from the remaining copies. Further, the receiver may combine all of the copies in an optimal way to recover as much of the communicated information as possible.

As another example, MIMO technologies, such as the Bell Labs Layered Space-Time (BLAST) technology, may be used to increase capacity of communications performed over a limited bandwidth. To achieve improved capacity, the information to be transmitted is divided into a number of separate information streams, where the number of separate information streams is equal to the number of transmitter antennas. The separate information streams are transmitted via different antennas to the receiver where they are decoded and reassembled into the original information generated at the transmitter. In essence, using MIMO technologies in such a manner creates parallel communications channels without requiring additional bandwidth. It is possible to construct a communications system with a transmission capacity that increases linearly as the number of transmitting and receiving antennas increase. For example, a MIMO system having two antennas at both the transmitter and the receiver may be capable of achieving double the capacity of a SISO system having only one antenna at both the transmitter and the receiver.

To achieve the advantages described above, a MIMO system should be capable of distinguishing between the signals transmitted via the multiple transmitter antennas. This may be accomplished by spacing the transmitter and receiver antennas apart such that the set of propagation paths generated by each transmitter antenna is different from those generated by the other transmitter antennas. The distance between the antennas may range from one-half the transmitter's operating wavelength to several operating wavelengths. These spacing requirements may make it difficult, if not impossible, to implement multiple antennas within a relatively small communications device.

The advantages of MIMO may be achieved for relatively small communications devices by employing polarization diversity. In polarization diversity, each of the multiple transmitter antennas transmits a signal using an antenna polarization that is different from that of the other antennas. Multiple antennas having polarizations that are orthogonal to one another may be placed together (i.e., co-located) and are not restricted by spacing requirements. As discussed in Andrews, "Tripling the capacity of wireless communications using electromagnetic polarization," Letters to Nature, Vol. 409, 18 Jan. 2001, pages 316-318, the teachings of which are incorporated herein by reference in their entirety, a MIMO system may be implemented using as many as three differently-polarized, co-located antennas.

Multi-polarized antenna arrays may also be used in wireless communications systems that employ polarization diversity without using MIMO technologies. For example, in wireless communications systems that transmit only one copy of a signal, the polarization of the signal relaying that single copy might not be aligned with the polarization of the receiver antenna. This misalignment may cause signal reception to be less reliable. To improve reliability in such cases, a multi-polarized antenna array may be used at the receiver. The multi-polarized antenna array receives multiple differently-polarized versions of the transmitted signal. The multiple differently-polarized versions may then be combined in a manner similar to the combining techniques employed for spatial diversity to improve reliability. Alternatively, the receiver may select the more reliable of the differently-polarized versions for decoding.

SUMMARY OF THE INVENTION

In one embodiment, the present invention is a multi-polarized antenna array comprising two or more planar antennas that are co-located and arranged orthogonally to one another such that the two or more planar antennas are characterized by two or more different polarizations. Each planar antenna comprises first, second, and third antenna conducting elements, and a transmission line. The first antenna conducting element comprises a first straight segment, a first arm, and a second arm, each arm having a proximal end and a distal end. The second antenna conducting element comprises a second straight segment and a third arm, the third arm having a proximal end and a distal end. The third antenna conducting element comprises a third straight segment and a fourth arm, the fourth arm having a proximal end and a distal end. The transmission line comprises first and second transmission line conductors. The proximal ends of the first and second arms are coupled to opposite ends of the first straight segment and the distal ends of the first and second arms extend toward one another and away from the second and third antenna conducting elements. The second and third straight segments are aligned end to end, are separated by a gap, and are parallel to the first straight segment. The proximal ends of the third and fourth arms are coupled to opposite ends of the second and third straight segments, respectively, and the distal ends of the second and third arms extend toward one another and away from the first antenna conducting element. The first and second transmission line conductors are coupled to adjacent ends of the second and third straight segments, respectively.

In another embodiment, the present invention is a method for transmitting signals using the multi-polarized antenna array of the previous paragraph. The method comprises (a) providing the multi-polarized antenna array and (b) driving the transmission line of each of the two or more planar antennas of the multi-polarized antenna array with a corresponding outgoing signal.

In yet another embodiment, the present invention is a method for receiving signals using the multi-polarized antenna array of the previous paragraph. The method comprises (a) providing the multi-polarized antenna array and (b) receiving at the transmission line of each of the two or more planar antennas of the multi-polarized antenna array a corresponding incoming signal.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Figure 1:
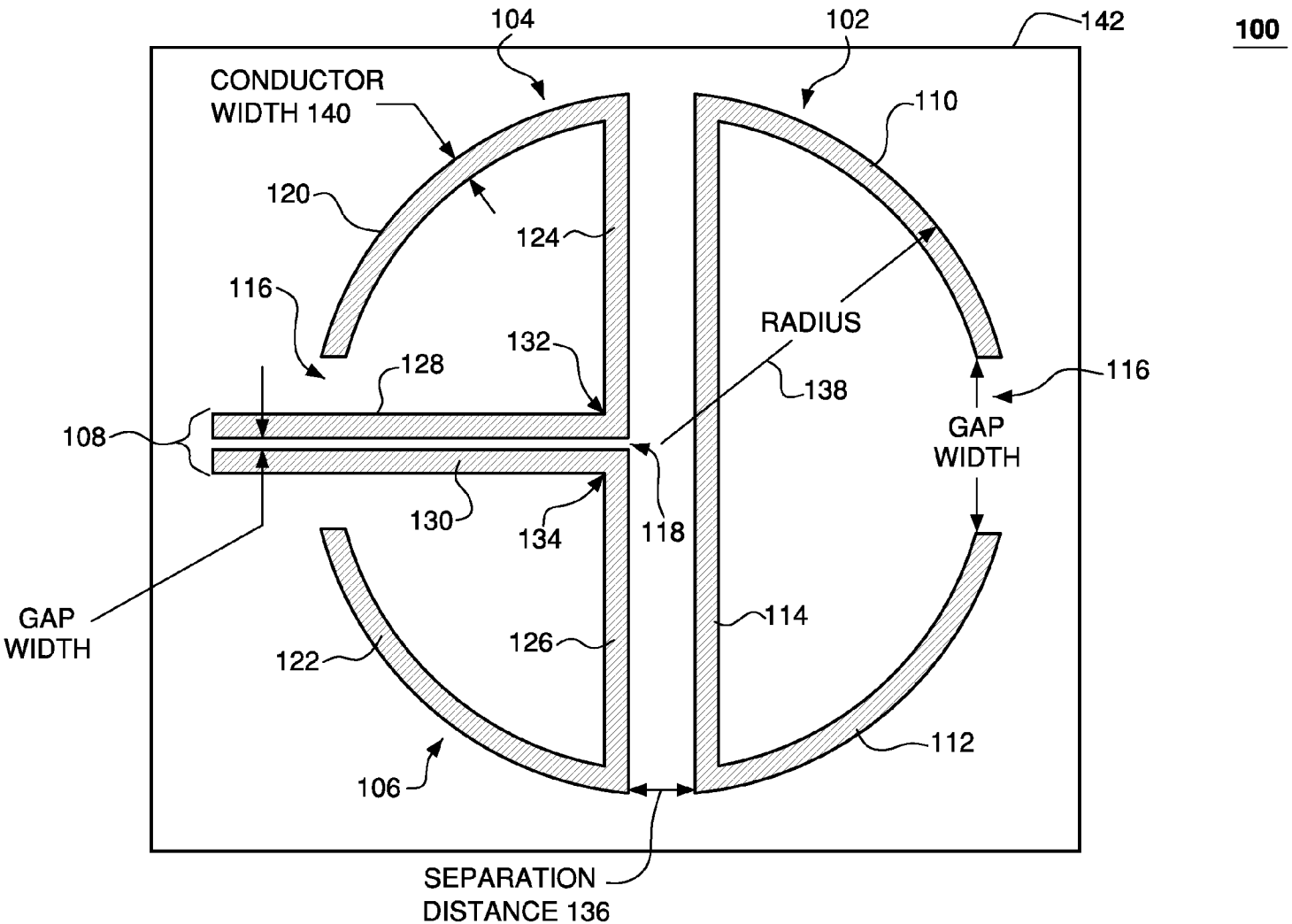
FIG. 1 shows a two-dimensional view of a linearly-polarized planar antenna that may be used to construct a multi-polarized antenna of the present invention.

FIG. 1 shows a two-dimensional view of a linearly-polarized planar antenna 100 that may be used to construct a multi-polarized antenna array of the present invention. The operability of planar antenna 100 is discussed in U.S. patent application Ser. No. 11/540,442 filed Sep. 29, 2006, the teachings of which are incorporated herein by reference in its entirety. Planar antenna 100 comprises (i) first antenna conducting element 102, (ii) second and third antenna conducting elements 104 and 106, which are adjacent to and oriented in the same plane as first conducting element 102, and (iii) transmission line 108. First antenna conducting element 102 comprises two curved segments 110 and 112 (i.e., the first and second arms) that are equal in length and straight segment 114 (i.e., the first straight segment). The proximal ends of first and second arms 110 and 112 are attached at opposite ends of first straight segment 114, and the arms extend away from second and third conducting elements 104 and 106 and towards one another. The distal ends of first and second arms 110 and 112 (i.e., the ends opposite the straight segment) are separated by gap 116.

Second and third antenna conducting elements 104 and 106 are separated by gap 118 and together form a mirror image of first antenna conducting element 102. Second antenna conducting element 104 comprises curved segment 120 (i.e., the third arm) that is equal in length to first arm 110 and second arm 112, and straight segment 124 (i.e., the second straight segment). Third antenna conducting element 106 comprises curved segment 122 (i.e., the fourth arm) that is also equal in length to first arm 110 and second arm 112, and straight segment 126 (i.e., the third straight segment). Second straight segment 124 and third straight segment 126, which are equal in length, are aligned end-to-end and are separated by gap 118. The cumulative length of second straight segment 124, third straight segment 126, and gap 118 is equal to the length of first straight segment 114 of first antenna conducting element 102. The proximal ends of third and fourth arms 120 and 122 are attached to opposite ends of second straight segment 124 and third straight segment 126, respectively, and the arms extend from away from first antenna conducting element 102 and towards one another. The distal ends of third and fourth arms 120 and 122 (i.e., the ends opposite second and third straight segments 124 and 126, respectively) are separated by gap 116. In the embodiment of FIG. 1, the arms of the first, second, and third antenna conducting elements are curved such that the overall footprint of the conducting elements is approximately circular.

Transmission line 108 provides (i) signals from the transmitter to planar antenna 100 for transmission and (ii) signals received by planar antenna 100 to the receiver. Transmission line 108 comprises (i) first transmission line conductor 128 that is coupled via node 132 to second antenna conducting element 104 and (ii) second transmission line conductor 130 that is coupled via node 134 to third antenna conducting element 106. Note that, as shown in FIG. 1, transmission line 108 need not be connected to first antenna conducting 102.

The separation distance 136 between (i) first antenna conducting element 102 and (ii) second and third antenna conducting elements 104 and 106 is selected such that, when energized, first antenna conducting element 102 is electromagnetically coupled to second and third antenna conducting elements 104 and 106. When energy is supplied to antenna 100, the entire structure resonates at a resonant frequency, inducing currents in the first, second, and third antenna conducting elements. The resonant frequency, which affects the operating wavelength of antenna 100, may be adjusted by changing various parameters, such as radius 138 of antenna 100, conductor width 140, the width of gap 116, and separation distance 136 between (i) first antenna conducting element 102 and (ii) second and third antenna conducting elements 104 and 106. By selecting suitable parameters, antenna 100 may be designed to have a resonant frequency that corresponds to an operating wavelength that is relatively long in comparison to the diameter of the conducting elements. For example, antenna 100 may be designed such that the diameter of the conducting elements is one-sixth the operating wavelength (i.e., diameter=λ/6, where λ is the wavelength of antenna 100).

Antenna 100 may be fabricated using a suitable fabrication technique commonly known in the art or that may be developed in the future. For example, antenna 100 may be fabricated using suitable printed circuit board materials. In FIG. 1, first antenna conducting element 102, second antenna conducting element 104, third antenna conducting element 106, and transmission line 108 may be traces etched onto substrate 142. As another example, first antenna conducting element 102, second antenna conducting element 104, third antenna conducting element 106, and transmission line 108 may be constructed using conducting wires that are adequately supported to achieve the overall circular footprint illustrated in FIG. 1. Note that, when conducting wires are used to fabricate antenna 100, the two transmission line conductors of transmission line 108 need not be aligned in the same plane as illustrated in FIG. 1.

To construct a dual-polarized or tri-polarized antenna array of the present invention, multiple instances of antenna 100 may be arranged orthogonally to one another such that the overall shape of the dual-polarized or tri-polarized antenna array is approximately spherical. The geometrical layout of antenna 100 allows multiple instances of antenna 100 to be implemented at the same location (co-located) such that the conducting elements do not intersect one another.

Figure 2:
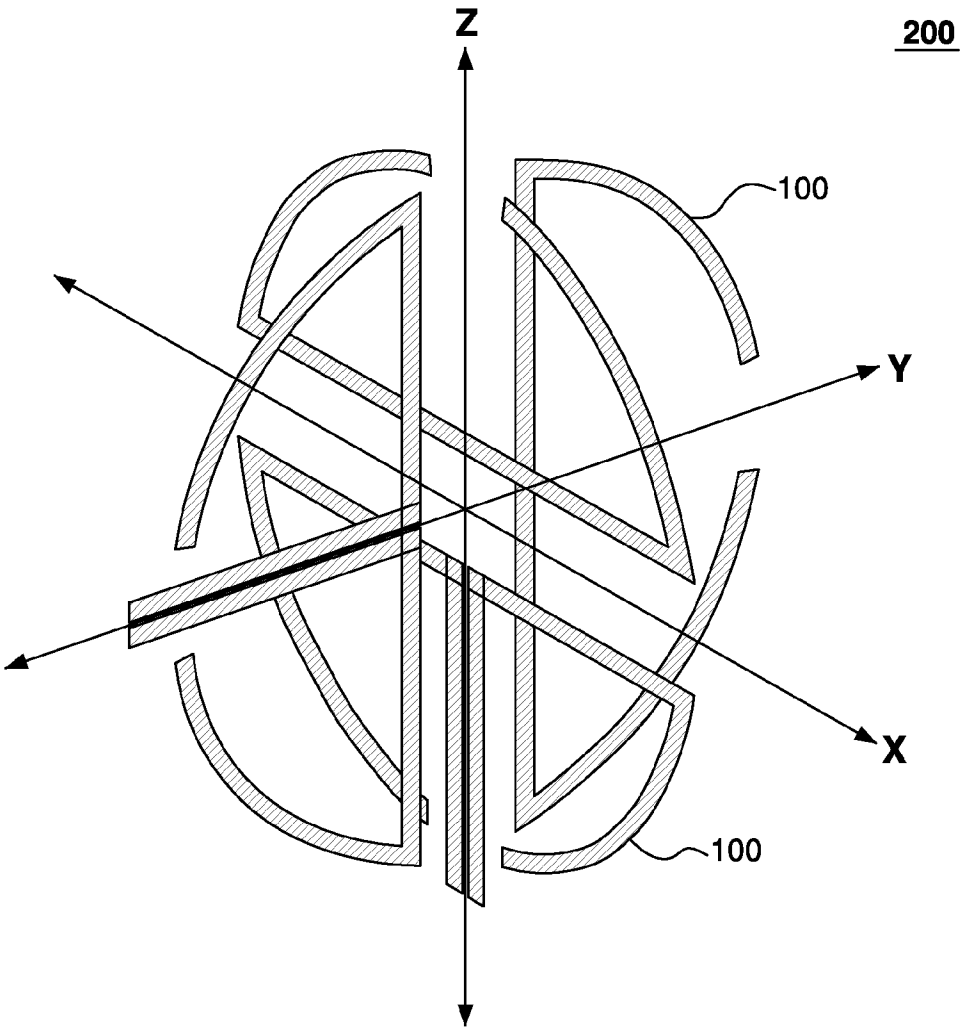
FIG. 2 shows a three-dimensional view of a dual-polarized antenna array according to one embodiment of the present invention.

FIG. 2 shows a three-dimensional view of a dual-polarized antenna array 200 according to one embodiment of the present invention. Dual-polarized antenna array 200 is constructed from two instances of linearly-polarized planar antenna 100 that are co-located and positioned orthogonally to one another. Note that, for clarity, substrate 142 is not shown for either instance of planar antenna 100. The first instance of planar antenna 100 is positioned in the y-z plane such that the straight segments of the first, second, and third antenna conducting elements are parallel to the z-axis. The second instance of planar antenna 100 is positioned in the x-z plane such that the straight segments of the first, second, and third antenna conducting elements are parallel to the x-axis.

Figure 3:
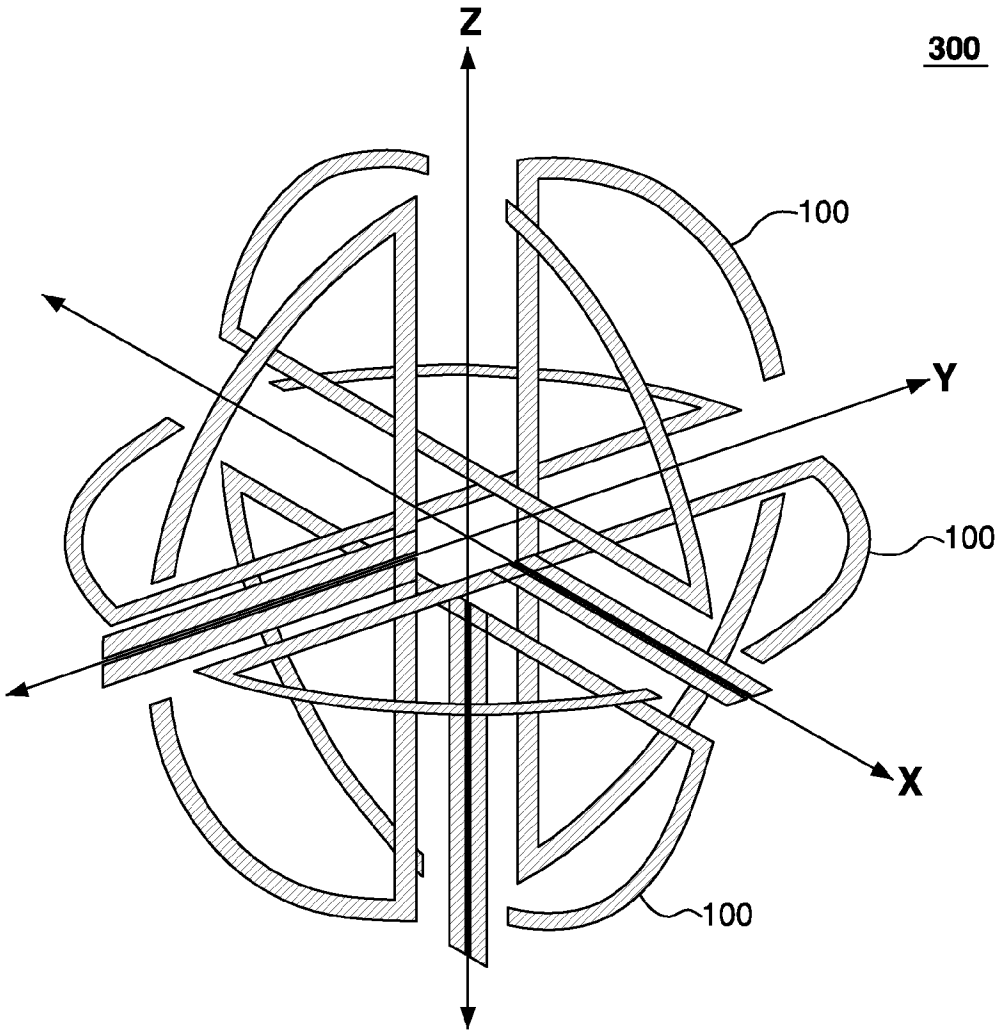
FIG. 3 shows a three-dimensional view of a tri-polarized antenna array according to one embodiment of the present invention.

FIG. 3 shows a three-dimensional view of a tri-polarized antenna array 300 according to one embodiment of the present invention. Tri-polarized antenna array 300 is constructed from three instances of linearly-polarized planar antenna 100 that are co-located and positioned orthogonally to one another. Similar to FIG. 1, substrate 142 is not shown for any of the instances of planar antenna 100. The first and second instances of planar antenna 100 are positioned in a manner similar to that of dual-polarized antenna 200 of FIG. 2. The third instance of planar antenna 100 is positioned in the x-y plane such that the straight segments of the first, second, and third antenna conducting elements are parallel to the y-axis.

When the multiple instances of antenna 100 are implemented using printed circuit board materials, the substrates of the individual instances may be fabricated with slots, for example between (i) first antenna conducting element 102 and (ii) second and third antenna conducting elements 104 and 106, such that the individual instances may be interlocked with one another. Alternatively, the substrates of the individual instances may be cut in half between (i) first antenna conducting element 102 and (ii) second and third antenna conducting elements 104 and 106, and, if necessary, the substrates may be cut between first and second transmission line conductors 128 and 130 of transmission line 108. The cut portions may then be reassembled as shown in FIGS. 2 and 3 such that the structure of each instance of planar antenna 100 is achieved. Various embodiments may also be envisioned in which dual-polarized or tri-polarized antenna arrays are constructed using a combination of slotted planar antennas 100 and cut planar antennas 100.

When the multiple instances of planar antenna 100 are implemented using conducting wires, the conducting wires should preferably be adequately supported such that each instance of antenna 100 achieves its intended structure. Note that dual-polarized or tri-polarized antenna arrays may also be envisioned in which one or more instances of antenna 100 are fabricated using printed circuit board materials and one or more other instances are implemented using conducting wires in a single multi-polarized antenna array.

One possible advantage of multi-polarized antenna arrays of the present invention is that they may be relatively small in size in comparison to the operating wavelengths of the multiple antennas 100. Such antenna arrays may be smaller than comparable multi-polarized antenna arrays (i.e., antenna arrays having the same operating wavelength) that are implemented using conventional dipole antennas. As described above, planar antenna 100 may be constructed to have a diameter that is one-sixth its operating wavelength. When two or more instances of planar antenna 100 are assembled, the resulting multi-polarized antenna array may occupy a spherical volume having a diameter that is one-sixth the operating wavelength of the planar antennas 100. The length of a conventional dipole antenna on the other hand typically ranges from one-half the antenna's operating wavelength (i.e., length of dipole antenna=λ/2) to several wavelengths. When two or more instances of a conventional dipole antenna are assembled, the resulting multi-polarized antenna array may occupy a volume in which each side is at least one-half the operating wavelength of the conventional dipole antennas.

Another advantage of the multi-polarized antenna arrays of the present invention is that the planar antennas 100 may be arranged orthogonally to one another such that the amount of cross-coupling between the individual planar antennas is relatively small.

Figure 4:
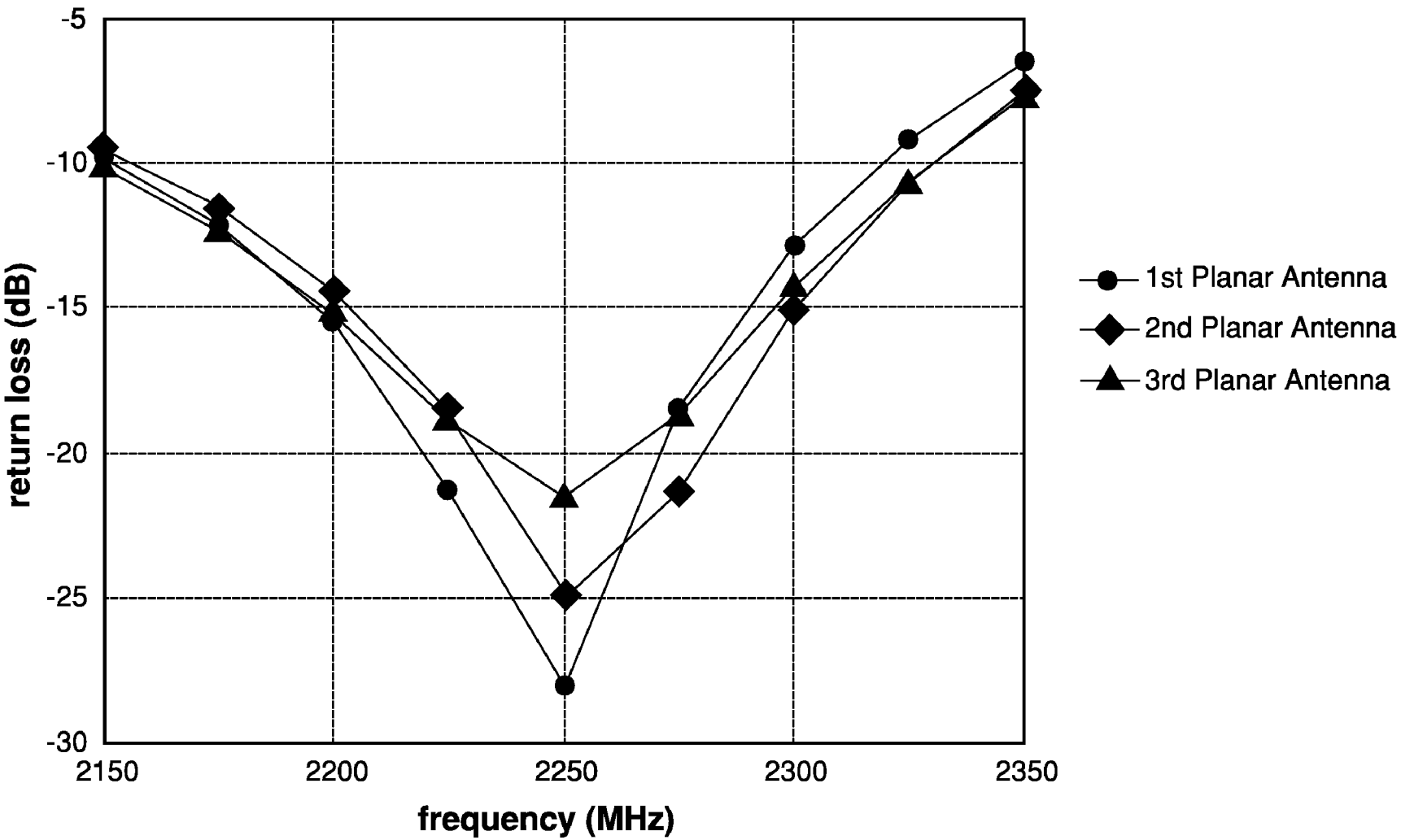
FIG. 4 graphically illustrates return loss versus frequency results of a simulation performed for a tri-polarized antenna of the present invention.

FIG. 4 graphically illustrates return loss versus frequency results of a simulation performed for a tri-polarized antenna array of the present invention. The simulation was performed using finite-element analysis, and the tri-polarized antenna array comprised three planar antennas, each having a diameter of 31 mm, a gap size of 5 mm (e.g., gap 116), a separation distance (e.g., 136) between (i) first antenna conducting element 102 and (ii) second and third antenna conducting elements 104 and 106 of 5 mm, a conductor width (e.g., 140) of 1 mm, and no substrate. The operating frequency of each planar antenna was 2250 MHz, which corresponds to an operating wavelength of 133 mm. Thus, the diameter of each planar antenna was less than one-quarter of its operating wavelength (i.e., 31 mm/133 mm≈0.24).

Return loss represents the amount of energy reflected from a planar antenna back to the transmitter due to impedance mismatch over the amount of energy provided to the planar antenna by the transmitter. In FIG. 4, each curve corresponds to one of three planar antennas. As shown, the return loss for all three planar antennas is smallest at the operating frequency of 2250 MHz, and increases as the frequency increases or decreases. Note that, ideally, one would expect the three curves to be identical. However, due to differences in the computation mesh used by the finite-element analysis, the curves are slightly different.

Although planar antenna 100 of FIG. 1 was described in terms of having conducting elements with a circular footprint, the present invention is not so limited. The straight segments and arms of planar antenna 100 may be arranged such that the overall footprint of the conducting elements is non-circular. For example, the overall footprint may be oval. Further, dual-polarized and tri-polarized antenna arrays of the present invention may be constructed using planar antennas having conducting elements that are non-circular. Accordingly, the resulting shapes of these dual-polarized and tri-polarized antenna arrays may be non-spherical.

According to various embodiments of the present invention, dual-polarized and tri-polarized antenna arrays may be constructed from multiple instances of a planar antenna that are not identical. For example, according to some embodiments of dual-polarized and tri-polarized antenna arrays, one or more of the planar antennas may be designed to have operating frequencies that are different from one or more of the other planar antennas. This may be accomplished by varying, from one planar antenna to the next, parameters such as (i) the radius of the planar antenna, (ii) the conductor width, (iii) the width of the gaps that separate the distal ends of the arms of the antenna, and (iv) the separation distance between the first antenna conducting element and the second and third antenna conducting elements. This may be particularly advantageous, for example, in multi-mode communications systems that operate using multiple radio access technologies over multiple frequencies.

Unless explicitly stated otherwise, each numerical value and range should be interpreted as being approximate as if the word "about" or "approximately" preceded the value of the value or range. Similarly, each use of the terms "equal," "equivalent," "similar," "the same," or "identical" should be interpreted as being approximate as if the word "about" or "approximately" preceded the terms.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

For purposes of this description, the terms "couple," "coupling," or "coupled" refer to any manner known in the art or later developed in which energy is allowed to be transferred between two or more elements, and the interposition of one or more additional elements is contemplated, although not required.

We claim:

1. A multi-polarized antenna array comprising two or more planar antennas that are co-located and arranged orthogonally to one another such that the two or more planar antennas are characterized by two or more different polarizations, wherein each planar antenna comprises:

a first antenna conducting element comprising a first straight segment, a first arm, and a second arm, each arm having a proximal end and a distal end;

a second antenna conducting element comprising a second straight segment and a third arm, the third arm having a proximal end and a distal end;

a third antenna conducting element comprising a third straight segment and a fourth arm, the fourth arm having a proximal end and a distal end; and a transmission line comprising first and second transmission line conductors, wherein:

the proximal ends of the first and second arms are coupled to opposite ends of the first straight segment and the distal ends of the first and second arms extend toward one another and away from the second and third antenna conducting elements;

the second and third straight segments are aligned end to end, are separated by a gap, and are parallel to the first straight segment;

the proximal ends of the third and fourth arms are coupled to opposite ends of the second and third straight segments, respectively, and the distal ends of the second and third arms extend toward one another and away from the first antenna conducting element; and the first and second transmission line conductors are coupled to adjacent ends of the second and third straight segments, respectively.

2. The invention of claim 1, wherein each of the first, second, and third antenna conducting elements of each planar antenna is fabricated from a conducting wire of uniform width.

3. The invention of claim 1, wherein each planar antenna is fabricated from printed circuit board materials.

4. The invention of claim 1, wherein the first, second, and third antenna conducting elements of each planar antenna have a combined footprint that is approximately circular.

5. The invention of claim 4, wherein each planar antenna has a diameter that is approximately at least one-sixth of a resonant wavelength of the planar antenna.

6. The invention of claim 4, wherein the multi-polarized antenna array has an overall shape that is approximately spherical.

7. The invention of claim 1, wherein the multi-polarized antenna array has exactly two planar antennas.

8. The invention of claim 1, wherein the multi-polarized antenna array has exactly three planar antennas.

9. The invention of claim 1, wherein the two or more planar antennas have the same resonant frequency.

10. The invention of claim 9, wherein the two or more planar antennas are adapted to transmit, respectively, two or more different streams of information concurrently.

11. The invention of claim 9, wherein the two or more planar antennas are adapted to transmit, respectively, two or more copies of an information stream concurrently.

12. The invention of claim 9, wherein the two or more planar antennas are adapted to receive, respectively, two or more different streams of information concurrently.

13. The invention of claim 9, wherein the two or more planar antennas are adapted to receive, respectively, one or more copies of an information stream concurrently.

14. The invention of claim 1, wherein, for each planar antenna, the first antenna conductor element is separated from the second and third antenna conductor elements.

15. The invention of claim 1, wherein the first, second, and third straight segments of different planar antennas are mutually orthogonal.

16. A method for transmitting signals, the method comprising:

(a) providing a multi-polarized antenna array comprising two or more planar antennas that are co-located and arranged orthogonally to one another such that the two or more planar antennas are characterized by two or more different polarizations, wherein each planar antenna comprises:

a first antenna conducting element comprising a first straight segment, a first arm, and a second arm, each arm having a proximal end and a distal end;

a second antenna conducting element comprising a second straight segment and a third arm, the third arm having a proximal end and a distal end;

a third antenna conducting element comprising a third straight segment and a fourth arm, the fourth arm having a proximal end and a distal end; and a transmission line comprising first and second transmission line conductors, wherein:

the proximal ends of the first and second arms are coupled to opposite ends of the first straight segment and the distal ends of the first and second arms extend toward one another and away from the second and third antenna conducting elements;

the second and third straight segments are aligned end to end, are separated by a gap, and are parallel to the first straight segment;

the proximal ends of the third and fourth arms are coupled to opposite ends of the second and third straight segments, respectively, and the distal ends of the second and third arms extend toward one another and away from the first antenna conducting element; and the first and second transmission line conductors are coupled to adjacent ends of the second and third straight segments, respectively;

(b) driving the transmission line of each of the two or more planar antennas with a corresponding outgoing signal.

17. The invention of claim 16, wherein the corresponding outgoing signals of step (b) correspond, respectively, to two or more different information streams.

18. The invention of claim 16, wherein the corresponding outgoing signals of step (b) correspond, respectively, to two or more copies of an information stream.

19. The invention of claim 16, wherein the first, second, and third straight segments of different planar antennas are mutually orthogonal.

20. A method for receiving signals, the method comprising:

(a) providing a multi-polarized antenna array comprising two or more planar antennas that are co-located and arranged orthogonally to one another such that the two or more planar antennas are characterized by two or more different polarizations, wherein each planar antenna comprises:

a first antenna conducting element comprising a first straight segment, a first arm, and a second arm, each arm having a proximal end and a distal end;

a second antenna conducting element comprising a second straight segment and a third arm, the third arm having a proximal end and a distal end;

a third antenna conducting element comprising a third straight segment and a fourth arm, the fourth arm having a proximal end and a distal end; and a transmission line comprising first and second transmission line conductors, wherein:

the proximal ends of the first and second arms are coupled to opposite ends of the first straight segment and the distal ends of the first and second arms extend toward one another and away from the second and third antenna conducting elements;

the second and third straight segments are aligned end to end, are separated by a gap, and are parallel to the first straight segment;

the proximal ends of the third and fourth arms are coupled to opposite ends of the second and third straight segments, respectively, and the distal ends of the second and third arms extend toward one another and away from the first antenna conducting element; and the first and second transmission line conductors are coupled to adjacent ends of the second and third straight segments, respectively;

(b) receiving at the transmission line of each of the two or more planar antennas a corresponding incoming signal.

21. The invention of claim 20, wherein the corresponding incoming signals of step (b) correspond, respectively, to two or more different information streams.

22. The invention of claim 20, wherein the corresponding incoming signals of step (b) correspond, respectively, to one or more copies of an information stream.

23. The invention of claim 20, wherein the first, second, and third straight segments of different planar antennas are mutually orthogonal.

* * * * *